US005727264A

United States Patent [19]

Craig et al.

[11] Patent Number: 5,727,264

[45] Date of Patent: Mar. 17, 1998

[54] SWIMMING POOL/SPA INTEGRATED STRUCTURE

[75] Inventors: Steven Alan Craig; Donald H. Weir, both of York, Pa.

[73] Assignee: Fox Pool Corporation, York, Pa.

[21] Appl. No.: 724,656

[22] Filed: Oct. 1, 1996

[51] Int. Cl.[6] ..... E04H 4/04

[52] U.S. Cl. ..... 4/489; 4/506

[58] Field of Search ..... 4/489, 506, 513; 52/169.7

[56] References Cited

U.S. PATENT DOCUMENTS 4,782,538 11/1988 Chisholm et al. ..... 4/506

5,415,221 5/1995 Zakryk ..... 4/489

*Primary Examiner*—Henry J. Recla

*Assistant Examiner*—Charles R. Eloshway

*Attorney, Agent, or Firm*—Arthur J. Plantamura

[57] ABSTRACT

The spa disposed outside the wall of the swimming pool is attached to the swimming pool, i.e., uses a part of the wall system of the swimming pool, by means of a special panel formed with an undercut or recessed portion that accepts a integrally formed at the top of the molded plastic spa. The result is a continuous flow of the wall system footing sad surrounding deck. The perimeter of the molded plastic modular spa shell is supported by panels that also incorporate the deck support system preferably an X-type brace support system used around the swimming pool. A continuous, homogenous concrete bond beam is poured around the entire perimeter of the pool and integrated spa. Operation of the pool and the spa (in either the spa spillway waterfall mode or spa mode) may be controlled by manually manipulating the valving system or by electronically activated motorized valves.

18 Claims, 5 Drawing Sheets

FIG. 12
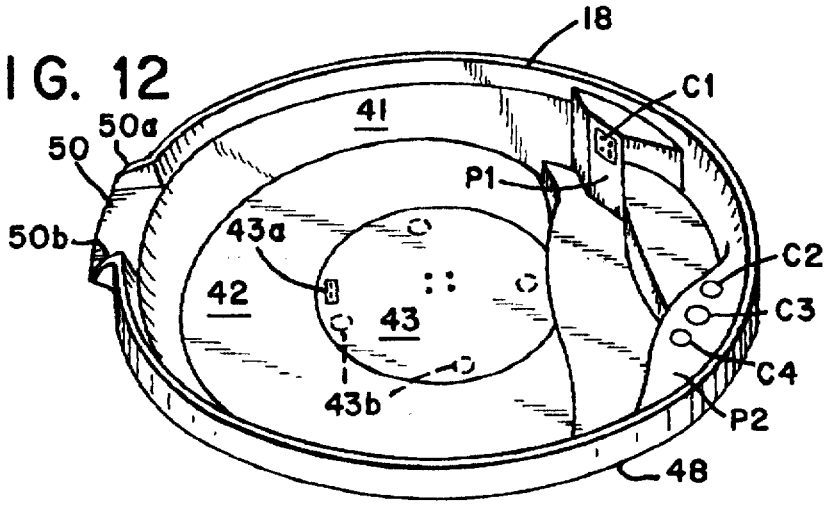
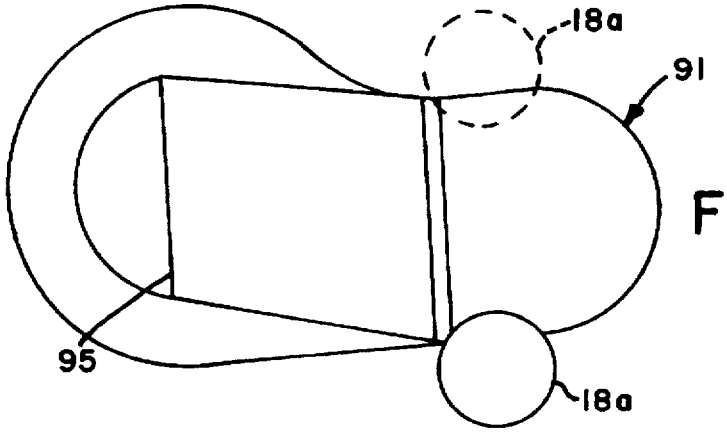
FIG. 13
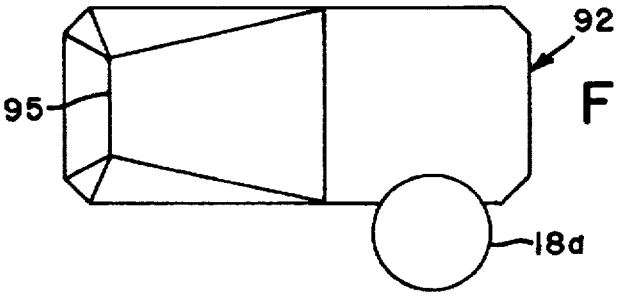
FIG. 14
FIG. 15
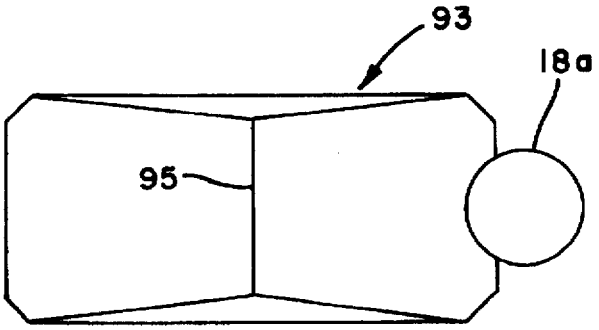

SWIMMING POOL/SPA INTEGRATED STRUCTURE

This invention relates to a swimming pool construction comprising modular wall panels joined end-to-end which, by minimal substitution of the modular panels and using a part of the wall of the swimming pool, permits, as an integrated part of the swimming pool facility, the inclusion of a therapy pool or spa. More particularly, the invention relates to a swimming pool construction wherein the substituted segment of the modular swimming pool wall functions as a part of the supporting wall of the swimming pool and as a part of the spa so as to present a "built in" or integrated appearance for the two unit thereby providing a novel continuity in the flow of the respective wall systems of the swimming pool and of the spa and permitting the pouring of a continuous homogeneous concrete bond beam around the entire perimeter of the swimming pool and spa.

BACKGROUND OF THE INVENTION

Various schemes have been proposed heretofore that are aimed at bringing together both a swimming pool and a spa, such as: placing a therapy pool contiguous to a swimming pool, including attaching the therapy pool to the wall for example, in U.S. Pat. No. 4,238,859; or devising the swimming pool so that one end thereof functions as a therapy pool as disclosed, for example, in U.S. Pat. No. 4,001,899; or depositing a removable partition comprising a therapy pool within the swimming pool as disclosed, in U.S. Pat. No. 4,240,165. However, all known prior arrangements have been found to be wanting in various respects including desired versatility of use, appearance, function and economy, for example. Accordingly, a need exists for a more simplified economical and aesthetically improved combination of this kind which conveniently and efficiently integrates a spa into a swimming pool facility as provided by the present invention.

SUMMARY OF THE INVENTION

The present invention provides a novel structure comprising a swimming pool that integrates generally within the confines of the swimming pool enclosure, a spa or therapy pool. The combination, when assembled in situ, permits the pouring of a continuous concrete bond beam around the entire perimeter of the swimming pool and around the integrated spa to present an attractive, relative solid and relatively durable construction. Further, the invention provides an improved and novel method for providing a combined integrated arrangement of this kind. In particular, the invention provides means to incorporate within the perimeter of an in-ground swimming pool, which is formed of a plurality of contiguously joined (supported at the back) modular wall elements, a spa or therapy pool. The form and design of the therapy pool or spa is so constructed and arranged that its inclusion with the swimming pool deck area is conveniently facilitated by replacing at least one wall panel module of the main swimming pool with a modular panel that functions as a part of the wall of the spa and, at the same time, as a part of the swimming pool wall. These respective portions of the swimming pool wall and the spa are devised to mate and to be securely fastened to contiguous wall panels to produce an integrated construction. At the common wall portion of the spa and swimming pool, a lip portion facing into the swimming pool is provided in the spa, allowing a controlled flow of water from the spa into the swimming pool. The "spa" or "therapy pool", which terms are used interchangeably, is devised and constructed to provide the desired interior occupant seating or lounging contour construction and may include, optionally, a removable panel in the foot well of the spa. The removable panel is inserted and supported within the spa substantially at the level of the seat of the spa and functions as a temporary floor to convert the spa into a child's wading pool using the spa seat level as the floor of the wading pool when the unit is not functioning as a therapy spa. Suitable water inlets, water turbulence generating means, i.e., pressurized water inlets, water skimming means, and other conventional spa or therapy unit accessories and controls therefore, are provided. The controls for operation of the spa are preferably accessible by the occupant of the spa. These controls located on the spa may include means interlocked with those for the swimming pool and are preferably devised to override the filter pump, water heater, and the like, controls that service the swimming pool.

It is accordingly an object of the invention to provide a novel combination comprising a therapy pool or spa which is separate from, but integrated into, the structure of a conventional swimming pool.

It is another object of the invention to provide a swimming pool/spa combination comprised of modular units. The provision of a spa at a place in the wall of the swimming pool, is effected by substituting a part of the outer wall of the swimming pool with a dual functioning modular wall panel, for the swimming pool and for the spa in place of at least one modular wall element of the swimming pool.

A further object of the invention is to provide a spa that is integrable with a swimming pool which, following the assembly in place of the swimming pool wall and of the spa wall, allows the builder to pour a continuous, totally homogenous concrete bond beam around the entire perimeter of the swimming pool and the integrated spa.

It is another object of the invention to provide a therapy spa in relation to a contiguous swimming pool which is devised and arranged to permit an optional controlled continuous flow of water from the therapy pool into the swimming pool.

It is a further object of the invention to provide a modular therapy spa which is an entirely separate water chamber, and which chamber is integrated into the swimming pool structure that is comprised of modular wall units.

Another object of the invention resides in the provision of an interior construction in the therapy pool which accommodates a spaced floor panel positioned at the level of the spa seating thereby permitting the optional conversion of the spa or therapy pool seat level to a child's wading pool floor when the spa is not functioning as an adult therapy spa.

Another object of the invention resides in the provision of means to permit the convenient lifting out and removal of the spa from the outer support wall for servicing of the plumbing or other repair of the spa unit.

Additional objects, advantages and capabilities afforded by the invention will become apparent from the accompanying drawing and the detailed description which follows:

DESCRIPTION OF THE DRAWING

FIG. 12 is a partial perspective view of the spa looking down into the interior of the unitary molded spa module.

FIG. 13, 14, and 15 are schematic illustrations of integrated pool/spa arrangements of the invention showing alternative positioning of the spa in relation to different shaped swimming pools.

DETAILED DESCRIPTION OF THE INVENTION

Figure 1:
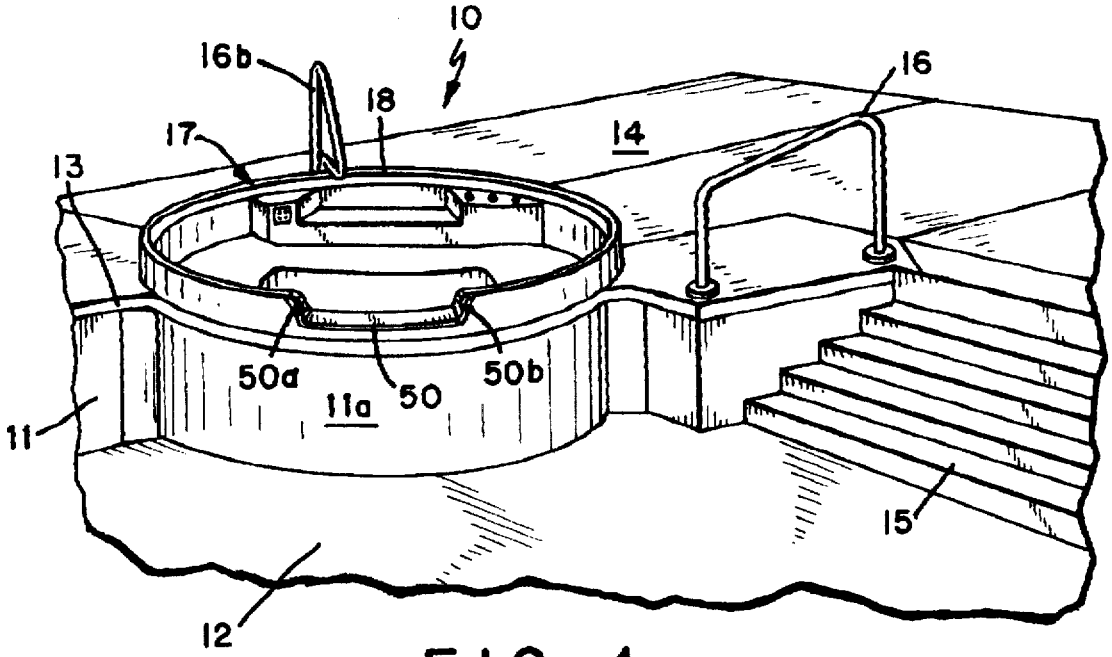
FIG. 1 is a perspective view of the combined spa or therapy unit in accordance with the invention shown in relation to a fragment of a swimming pool and as viewed from inside the swimming pool.
Figure 2:
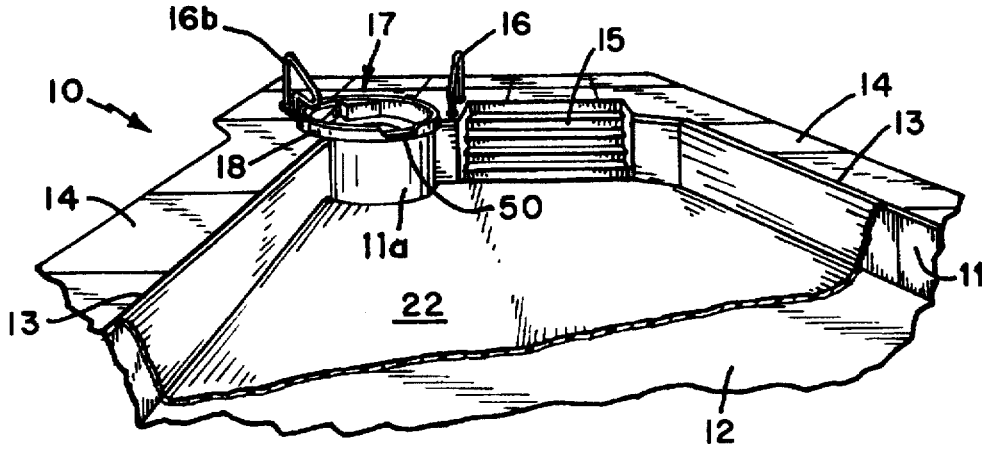
FIG. 2 is another perspective of the partially completed combination of the spa of the invention, shown in relationship to a segment of the swimming pool and better illustrating the integration of the spa within the deck surrounding the swimming pool.

The integrated combination of therapy pool (or spa) and swimming pool of the invention, in its preferred embodiment, contemplates a desirable and convenient way in the swimming pool trade to integrate a spa into previous commercially available pre-fabricated swimming pools of the kind which are shipped as a package to a purchaser of a swimming pool. The invention obviates the requirement of allocating a significant additional space for the inclusion of a spa and makes the spa available to a swimming pool purchaser for a relatively minor additional expense. The purchaser of the swimming pool thus may include a highly desirable therapy unit that is, functionally, most useful and which is aesthetically integrated into the swimming pool structure for a relatively minor added cost to the cost of the swimming pool alone. The spa utilizes the plumbing, filtering, heating, etc. facilities of the swimming pool. The therapy pool or spa comprises a modular add-on for essentially all of a wide variety of the standard commercially popular modular swimming pool packages that are on the market and that are formed by a plurality of wall panels that are joined end-to-end and supported at the back side of the wall panels to form the perimeter of the swimming pool. Such modular constructed swimming pools are disclosed for example, in U.S. Pat. Nos. 3,596,296, 4,661,247, and 4,797,957.

The integration of a spa into the structure of a swimming pool affords various advantages over known prior art installations that comprise a swimming pool and a detached or separately positioned spa even when the spa is situated in close proximity or appears attached to the swimming pool. The advantages of the spa integrated into the swimming pool arrangement in accordance with the invention include:

- better economy and convenience of support service equipment which would be used by both the swimming pool and the spa, e.g., the water pump, the water filter, the heater, etc.;
- compactness of the spa with the swimming pool involving economy of construction byway of the application of a unitary poured concrete footing and of a deck around the swimming pool and the spa;
- ground area space conservation since a single compact location accommodates both the swimming pool and spa without the concern to locate a different accommodation for the spa;
- enhancement in the availability of the spa, i.e., convenience, in the proximity of the contiguous swimming pool, when the spa is in use;
- efficiency in the maintenance of the swimming pool and the spa as an entity and economy in having the swimming pool and the spa using the same water processing services;
- provides in the spas a convenient accessory in that the spa may be used optionally and alternatively as a small child wading pool;
- affords a convenient site or overview (when the spa is in use by an adult) to monitor the safety of children in the main swimming pool.

While the spa is described in detail with reference to a construction in which the spa is located at a corner of a rectangular swimming pool, the spa construction of the invention, by appropriate modification of the angular disposition of the sides of the spa that are to be connected to the contiguous swimming pool wall panels, may be adapted for use with a swimming pool having a variety of shapes. Also, it is to be understood that the spa of the invention, while integrated into the peripheral structure of the swimming pool by substituting a supporting wall panel of the main swimming pool with wall panels that are common, i.e., used by both the swimming pool and the spa, the spa is a separate and distinct body of water and not a mere appended chamber with an open passage so that water can flow back and forth into and from the swimming pool. In other words, the spa is essentially a self-contained separate unit, usable independently of the swimming pool with water pumped into the spa optionally being permitted to spill into the main swimming pool. The spa is devised for a user to enter from the outside, and not from the interior, of the swimming pool. Unlike some prior arrangements involving swimming pools and spas, there is no passageway by an occupant of the spa between the swimming pool and the spa; the spa is not designed to be entered by an occupant inside the swimming pool, either by swimming into or walking into the spa from the interior of the swimming pool.

The separating support wall portion between the spa and the swimming pool comprises a part of the outer surrounding support wall for the spa as well as a part of the swimming pool support wall. This separating dual functioning wall portion is preferably provided with a recess or indentation at the top to receive the lip of the unitary molded plastic spa that is lowered into and positioned in the spa support wall. The water flow from the spa into the swimming pool is devised to provide a positive water flow over the lip of the spillway on the molded plastic spa's upper peripheral wall. Water pumped into the spa and overflowing into the swimming pool provides a desirable, steady, aesthetically pleasing "waterfall" effect through the spillway.

In the integrated installation of the therapy pool as contemplated by the present invention, one or more modular wall panels, depending upon the sizing and configuration of the swimming pool wall modules, are omitted from the swimming pool perimeter at the location where the spa is to be integrated and substituted with the dual functioning panel which forms a part of both the support wall for the swimming pool and a part of the support wall for the spa. Preferably in the case of a rectangular pool, the substituted dual functioning panel is located contiguous to a corner at the shallow end of the swimming pool. Suitable support means are provided at the points where the sides of the spa and the pool wall panels are joined and at the back and sides of the spa module to preclude the possibility of distortion of the aligned structure from settling soil, from frost, etc. Suitable support means may comprise and of various support systems including, for example, the adaptation of the support systems disclosed in U.S. Pat. Nos. 3,371,455 and 4,589,237, the disclosures of which are incorporated herein by reference.

Figure 6:
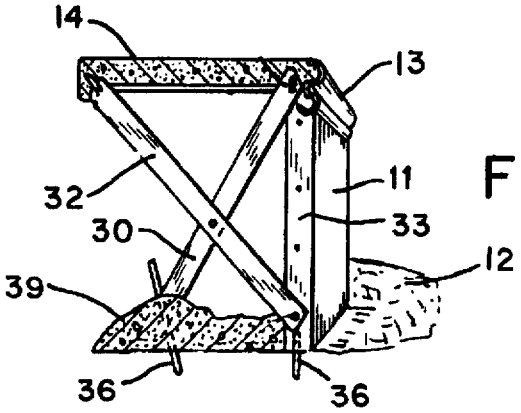
FIG. 6 is illustrative of the X-Brace supports for the swimming pool wall panel and for the spa outer wall panels and showing in cross section the concrete bond beam which is poured around the entire perimeter of the pool and integrated spa at the bottom and showing, supported at the top of the X-Brace member, the deck which is also continuous around the swimming pool and spa.

Referring now to the drawing, and more particularly to FIG. 1, a fragment of a swimming pool 10 is shown comprising a vertical perimeter wall 11, a floor 12, and deck portion 14 of a conventional swimming pool. Swimming pools of this kind comprise an enclosure formed from a plurality of panels usually corrosion resistant sheet metal, of a size such as four feet high and and six or eight feet long, that are joined end-to-end to form the swimming pool enclosure. The joined panels are braced on the back side at suitable intervals, preferably by an X-brace type support system comprising crossed brace legs 30 and 32, such as that illustrated by FIG. 6, which integrates a footing and supports the deck that surrounds the swimming pool as well as the contiguous spa in accordance with the invention, the spa being integrated at the shallow end of the swimming pool. This support arrangement conveniently lends itself to permitting the pouring of a continuous band of concrete for the footing that surrounds the swimming pool and the spa and a single band of poured concrete which forms the deck that surrounds the swimming pool and spa. The bracing system illustrated by way of FIG. 6 is described in greater detail in the aforementioned U.S. Pat. No. 3,371,455.

When the therapy pool or spa 17 is integrated into a rectangular shaped swimming pool the spa is preferably positioned near the corner of the swimming pool 10 by replacing one or more of the modular wall panels 11 of the swimming pool vertical support wall with a panel that functions both as a pare of the swimming pool support wall and as part of the spa support wall and by connecting contiguous panels 11 of the swimming pool with the side edges of the panel 11*a*. It will be apparent that with appropriate modification of the spa vertical wall panel portions that engage the wall panels of the swimming pool, the spa of the invention may be adapted to be integrated into swimming pools of other shapes such as the kidney shaped pool illustrated in FIG. 13 or oval shaped pools (not shown) and with respect to rectangular pools at locations in the pool walls other than at the corners by replacing the appropriate modular wall panels of the respective swimming pools as illustrated schematically in FIG. 14 and FIG. 15 of the drawing. Where required or desirable, supplemental panels (see 11*b* in FIGS. 3 and 4) may be introduced to bridge any space between the conventional swimming pool wall panels 11 and the substituted spa panel 11*a*. For purpose of providing a disclosure with greater specificity, however, reference is made detail to an integrated arrangement with a rectangular swimming pool and with a spa located substantially at a corner of the swimming pool.

Figure 5:
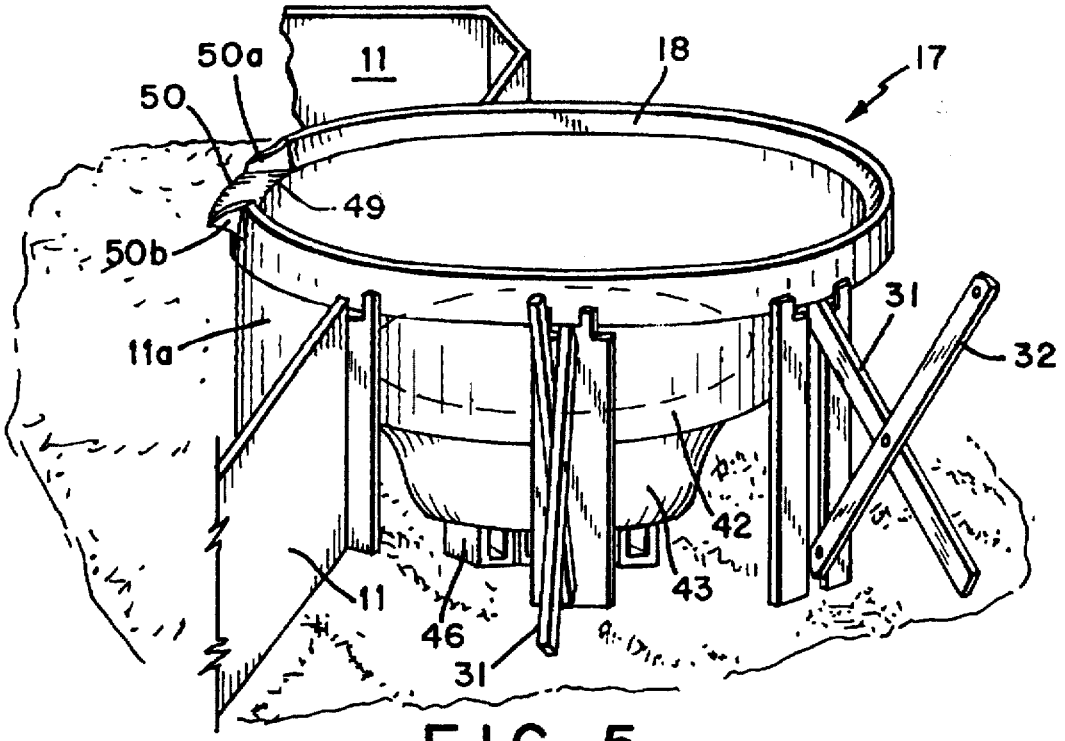
FIG. 5 is a perspective view taken generally from the exterior side of the pool as compared to FIG. 4 and illustrating in the process of construction the spa support wall with the molded plastic spa interior insert supported in place and on the bottom. For better illustration some of the spa outer wall panels are omitted.
Figure 7:
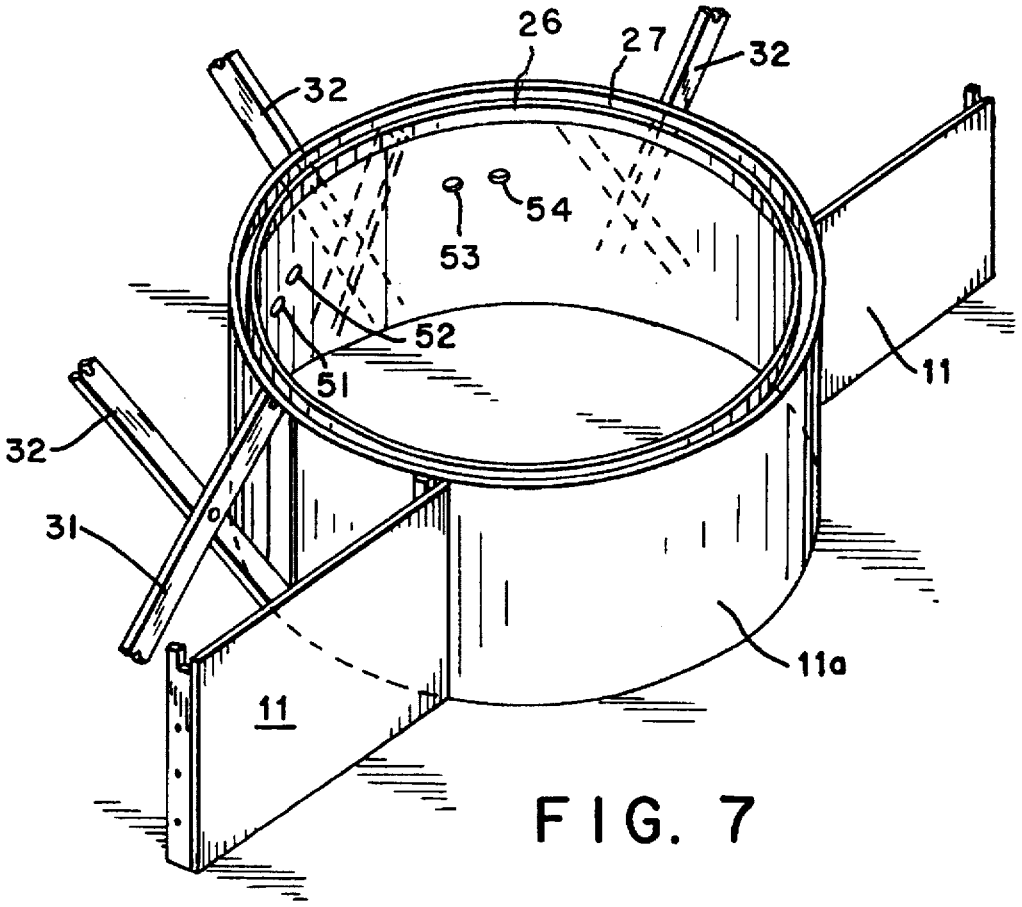
FIG. 7 is a schematic perspective of the spa outer wall with brace supports and shown in relationship to swimming pool connecting panels to the left and right of the spa outer wall, that is, to the left and right of the special wall panel that functions both as a part of the swimming pool wall and as a part of the spa outer wall.

Referring again to FIG. 1 as viewed from the inside of the swimming pool, a spa 17 is integrated with the swimming pool 10. The modular wall panels 11 forming the swimming pool peripheral enclosing wall contiguous to the corner of the swimming pool are omitted and replaced with an inwardly bowed panel 11*a* and connected at its side edges to the side flanges of the contiguous swimming pool wall panels 11. See FIGS. 5 and 7 of the drawing in which the reference numeral 11 designates the swimming pool wall panel and reference numeral 11*a* refers to the substitute wall panel that functions in the dual capacity as a part of the spa support wall and as a part of the swimming pool supporting wall. The swimming pool vertical wall panels 11 are connected with or without additional relatively narrow panels 11*b* (not shown in FIGS. 5 and 7) as may be needed to the left and right edges of the dual functioning panel 11*a* by bolting or otherwise suitably securing it to the swimming pool wall panels 11. If desired, the connection may be formed as to be substantially water tight such as by incorporating a rubber or other yieldable composition gasket where the edges of the wall panel and of the spa are secured. However, since conventionally, a water impermeable vinyl plastic liner is draped over and covers the entirety of the vertical wall panels 11 (and 11*a*) and the floor 12 of the swimming pool, wall panel joints having water tight integrity are optional and usually unnecessary. The connection between the modular parts, as is generally acknowledged in the art, should preferably be formed so as to have a sufficient yield to guard against damage that might otherwise occur from external forces, such as, freeze thaw cycles. To prevent strain at the connection between the side edges of the spa panel 11*a* and the contiguous swimming pool wall panels 11 and to better support the weight of the spa, a support system such as that of the aforementioned U.S. Pat. No. 4,589,237 (for vertically adjustable support purposes) and a wall bracing and deck support system such as that disclosed in U.S. Pat. No. 3,511,002 may be adapted, the disclosures of which patents are incorporated herein by reference. The spa 17 of the invention is provided with an interior lounge area comprising a lower foot well chamber including a floor 43 (see FIG. 8) which accommodates an occupant's feet and a seat portion 42 elevated at a height from the spa floor 43 to afford comfortable seating for occupants.

Figure 3:
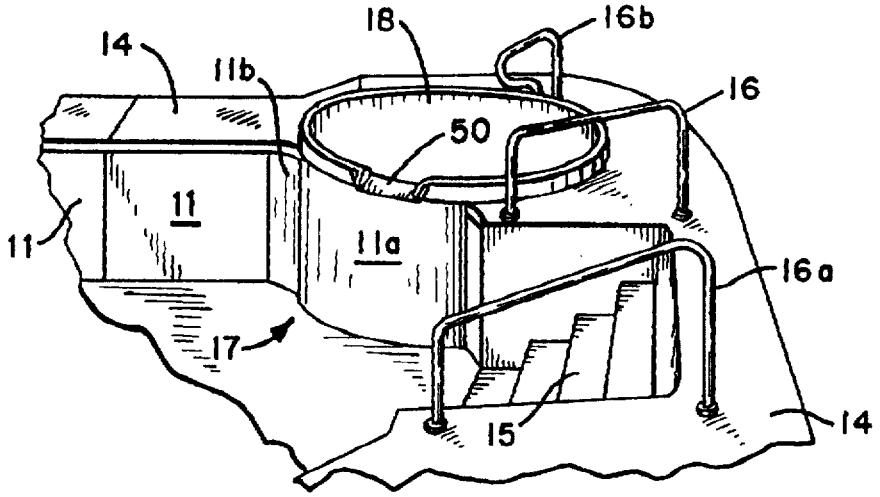
FIG. 3 is another perspective view of the partially completed spa/pool combination in enlarged detail illustrating the deck which encompasses both the swimming pool as well as the spa also as viewed from inside the swimming pool.
Figure 4:
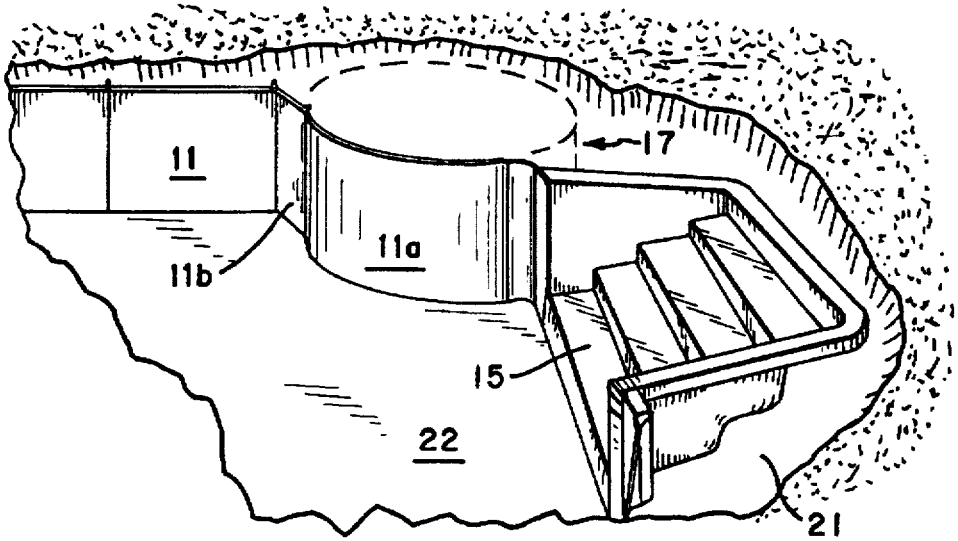
FIG. 4 is a perspective view of a part of the swimming pool viewed during partial construction from the interior of the pool wall illustrating wall panels joined end-to-end and showing the substituted wall section of the swimming pool which functions as a part of the spa module outer support wall.

As shown in FIGS. 1–4 the swimming pool may incorporate a suitable stairway 15 and one or more handrails 16, 16a and 16b (FIG. 3). A suitable, conventional, preferably molded plastic coping 13 is secured peripherally at the upper edge of the swimming pool wall and forms a smooth transition between the vertical wall and the horizontal deck. The coping which is usually formed, i.e., extruded or molded from plastic or formed of a metal, incorporates at least one, and preferably at least two, bead retaining channel (s) to secure the vinyl swimming pool liner of the kind that conventionally covers the walls and floor of the swimming pool. Additional channels in the coping maybe used to secure the bead of a swimming pool cover or other accessories.

Figure 8:
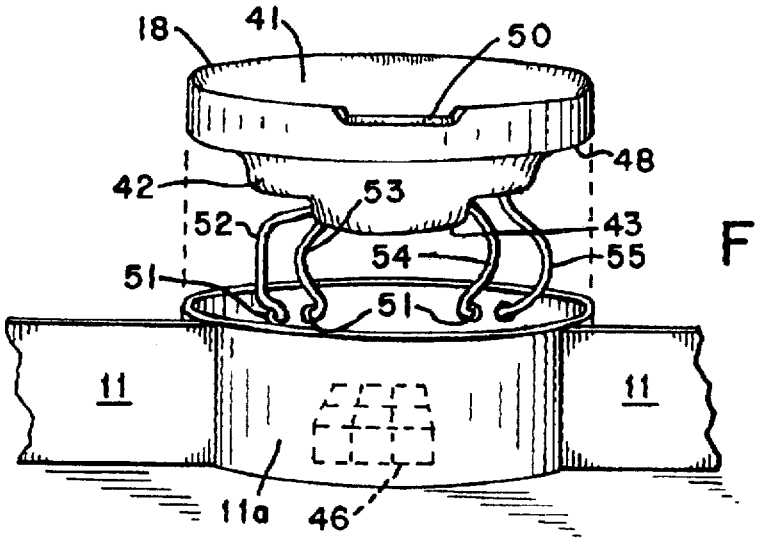
FIG. 8 is a schematic perspective expanded view of FIG. 7 in which a unitary molded plastic body is shown elevated out of the surrounding outer wall that supports the one piece molded plastic spa unit in place and showing plumbing lines and (in phantom) support means for the bottom of the spa when the spa is lowered in place in the spa outer support wall.

The molded plastic spa 18 is equipped with conventional plumbing facilities such as plumbing to withdraw, to filter and to return the water in both the swimming pool and the spa and air jets to produce the desired water turbulence and optionally, may contain a skimmer (not shown) and serviced by reference to the plumbing piping illustrated in FIG. 8.

Suitable conventional controls, C1, C2, and C3 for regulating the water circulation and turbulence are illustrated on the console panels P1 and P2 of the spa and shown in FIG. 12.

Figure 10:
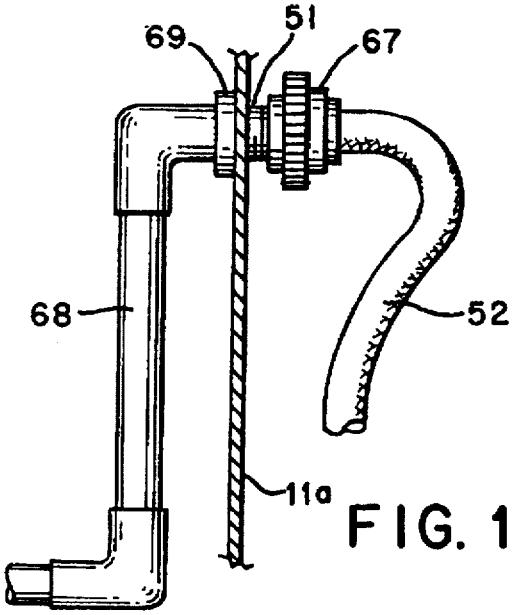
FIG. 10 illustrates one form of a quick connected/disconnected flexible connection for servicing the plumbing through the spa support wall.

The level of the water pumped into the spa is devised to be pumped optionally but preferably at a rate to maintain the level slightly higher than the level of the water in the swimming pool so as to create a waterfall effect as water which is pumped into the spa flows over the spillway 50 into the swimming pool. Quick connect/disconnect couplings 67 and flexible plumbing tubing 52, 53, 54, and 55 are preferably employed to facilitate the removal and servicing of the molded spa body from its exterior supporting wall 11a through openings 51 in that portion 25 of the wall 11a as illustrated generally in FIG. 10.

The spa 17, as generally illustrated in FIG. 8 comprises an inner prefabricated one-piece synthetic resin molded unit 18 which is conveniently supported in an outer support wall formed by the supporting metal spa panels 11a and the contiguously joined wall panels around the spa. The upper rim of the molded plastic spa unit 18 is provided with an integrally molded, outwardly depending lip 48 which fits into an opening 27 formed by flange member 26 which is secured to the spa outer wall supporting panels 11a and to contiguous spa wall support panels, as the spa shell 18 is lowered onto the supporting wall formed by the panel 11a and contiguously connected spa wall support panels connected to panel 11a. A spillway recess or opening 49 with a lip 50 which is integrally formed or which is applied on the spillway 49 which may also be integrally molded on the spa body 18 fits on the outer support panel 11a which functions in the dual capacity as a part of the swimming pool vertical supporting wall and as a part of the outer vertical support wall for the spa 18. The lip 50 may be and preferably is slightly longer than the spillway opening 49 and is preferably formed with upturned ends 50a and 50b to better confine the water flow and channel the water flow in a smoother more uniform waterfall effect.

Figure 9:
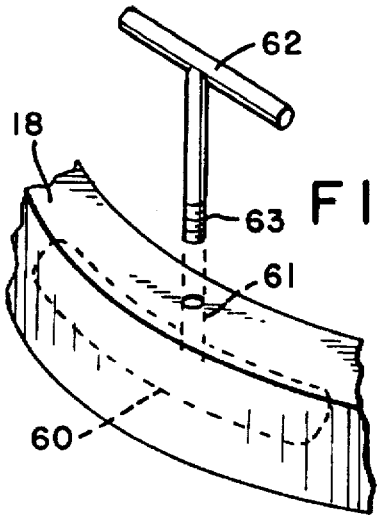
FIG. 9 is a fragmentary perspective view showing one means to facilitate the lifting of the molded spa body from its outer surrounding Supporting wall for servicing.

To facilitate the lifting for servicing of the prefabricated molded spa unit 18 upwardly out of the outer supporting enclosure (formed by panels 11a and contiguously connected modular spa support panels), an insert 60 with a key receiving opening 61 is integrated into or fastened underneath the upper part of the molded plastic spa body 18 and which receives a removable "T" handle 62 as illustrated by FIG. 9.

As noted hereinabove, the water filtering, heating, and recirculation system of the swimming pool is used also for servicing the spa.

Figure 11:
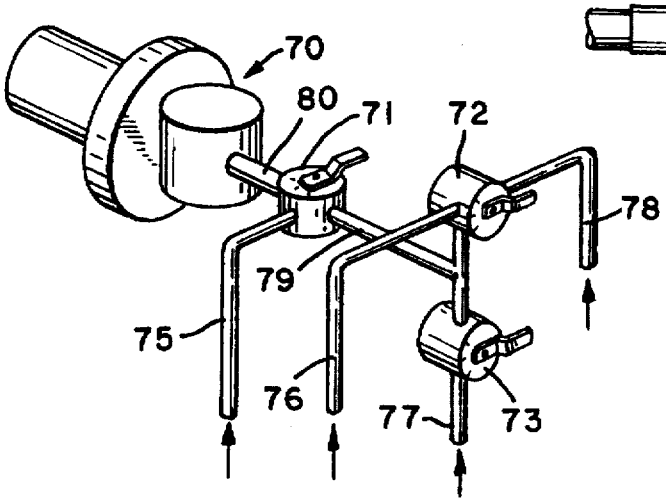
FIGS. 11 and 11A are illustrative perspectives of plumbing arrangements that may be employed to service the suction side and the return side, respectively, of the pool/spa integrated unit of the invention.
Figure 11A:
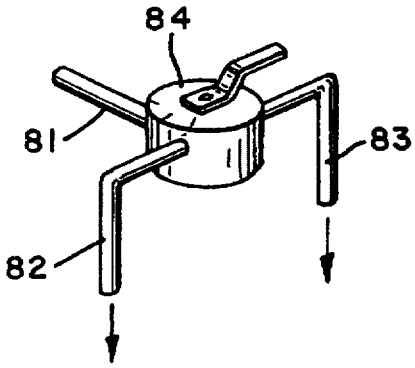

As shown reference to FIGS. 11 and 11A which generally illustrate the plumbing arrangement for the water suction side and for the water return side of the plumbing system, when the spa is in use, i.e. in the spa mode, the pump suction from the swimming pool is shut off and the spa suction is operative. Thus, in effect, by closing the swimming pool 3-way valve 71 via line 80 to the pump 70, water from the spa is thereupon drawn through line 75 only. Spa water is filtered and heated and returned to the spa 81. The return valve 84 is positioned to provide water flow to the spa only via line 82. This configuration allows water to be withdrawn from the spa only. The water is filtered, heated and returned to the spa. The swimming pool water is not being filtered or circulated while the system is in the "spa mode."

As shown by reference to FIG. 11, when the swimming pool is in use (swimming pool mode), the suction from the spa is shut off and the swimming pool suction is operative. Thus, in effect, by closing the swimming pool/spa 3-way valve 71 via line 80 to the pump 70, water from the swimming pool is thereupon drawn through line 79 only. Valves 72 and 73 are open so that the swimming pool skimmers may continue to function through the lines 76 and 78 while water from the main drain of the swimming pool is drawn through line 77. the purpose of the valves 72 and 73 is to allow for the closing of valve 73 and the closing of one skimmer line (either line 76 or 78) when the swimming pool is being cleaned via a vacuum attachment place inside of of one of the swimming pool surface skimmers. Swimming pool water is filtered and heated and returned to the swimming pool via line 81. The return valve 84 is positioned to provide water flow to the swimming pool only via line 83. An arrangement of this kind allows water to be withdrawn from the swimming pool only. The water is filtered, heated and returned to the swimming pool. Water in the spa is not being filtered or circulated while the system is in the swimming pool mode. As illustrated by reference to FIG. 11, when it is desired to have water spill from the spa into the swimming pool over the lip 50 of the spa 18 (the waterfall mode), the spa suction is shut off and the swimming pool suction is operative. Thus, in effect, by closing the swimming pool/spa 3-way valve 71 via line 80 to the pump 70, water from the swimming pool is thereupon drawn through the line 79. Valves 72 and 73 are open so that the swimming pool skimmers may continue to function through lines 76 and 78 while water from the main drain of the swimming pool is drawn through line 77.

Swimming pool water is filtered, neared and returned to the spa (waterfall mode) via line 81. The return valve 84 is positioned to provide water flow to the spa only via line 82. This arrangement allows water to be withdrawn from the swimming pool only. The water is filtered heated and returned to the spa only. The continuous flow of water from the swimming pool into the spa allows for the increased volume of water into the spa to overflow over the spillway 50 of the molded plastic spa shell and create a steady waterfall effect.

It is apparent that the spa of the invention may be operated exclusively of the swimming pool such as when the swimming pool is being repaired or has been inactivated during relatively colder weather.

Suitable, additional controls such as for governing water flow quantity for turbulence generation, for temperature adjustment, and the like, and are of a kind that are well known to those skilled in the art, are shown a C. The controls C, optionally, may interlock with, and override, the swimming pool controls (not shown) for similar functions attendant to the swimming pool.

It is thus seen that the improved swimming pool/spa combination of the invention includes a spa that can be used as a hydrotherapy spa, the spa shell includes a spillway opening which allows the water to overflow into the swimming pool and an insert that covers the foot well area and creates a shallow wading pool for children.

The spa is attached to, i.e., uses a part of, the wall system of the pool by means of a special panel with a receiver channel that accepts the lip of the spa. The result is a continuous flow of the wall system around the swimming pool and the spa and a "built-in" appearance for the combination.

The remaining perimeter of the spa shell is supported by panels that also incorporate the deck support system preferably an X-Brace type support system used around the swimming pool. This construction allows the builder to pour a continuous, totally homogenous concrete bond beam around the entire perimeter of the pool and integrated spa.

The X-Brace bracing system, as illustrated in FIG. 6, comprises a pair of cross members 30 and 32, preferably formed of metal but these members may comprise any suitable rigid material such as wood or plastic. The members 31 and 32 are connected at 30, i.e., at a point intermediate the ends thereof, and are suitably secured and held in place at the base thereof, such as by means of stakes 36, until concrete 39 is poured at these bottom ends of the legs ends and hardens thereby fixing the bracing member legs 31 and 32 in place. The top of the brace leg 31 and the bottom of brace leg 32 are secured at 34 to the wall supporting flanges 33 (see FIG. 6).

Operation of the pool and the spa (in either the spa spillway waterfall mode or spa mode without the overflow) may be controlled by manually manipulating the valving system or by electronically activated motorized valves (not shown). The valving system allows the homeowner to operate: (1) the pool only, where water is circulated from the main drain and skimmer(s) and returned to the pool; (2) spa in waterfall mode, where water is circulated from the pool's main drain and skimmer(s) and directed to the spa's jetting system and allowed to overflow back into the pool, or (3) spa in spa mode, where the pool valving is closed and the spa water only is circulated from the spa's bottom suction and skimmer and recirculated back to the spa jetting system.

The wall system has two separate suction fittings and two separate return fittings permanently attached. On the inside of the wall system these fittings have detachable unions which are connected to the appropriate plumbing line from the waterfall spa. This system allows for easy spa removal in case there is a need for repair to the waterfall spa shell and/or plumbing.

A means is provided of inserting "T" handles into the lip of the waterfall spa in order to lift the spa out of the encircling outer support wall formed by the substitute panel (s) 11*a* and panels contiguously connected thereto that comprise the outer support wall for the molded plastic integrally formed spa body from the support enclosing wall whenever spa removal is necessary.

If desired the spa 18 may be secured in place in the support wall by a suitable conventional means such as a quarter turn latch in which case the "T" handle 62 (FIG. 9) is given a quarter turn to unlatch and permit the lifting out of the spa 18 from its outer support wall.

Similarly with respect to the spa footwell cover 43 (FIG. 12) that is positioned at the seat level of the spa and forms a floor for a child's wading pool that comprises the are of the inserted panel and of the area of the seating at a seat level of the spa, thereby converting the spa to a child wading pool having a water depth to the spa seating level. The inserted panel 43 is positioned and preferably locked in place over the footwell area and at the seat level. A suitable conventional locking means, such as a quarter turn latch 43*a* at the underside of panel 43 with an opening at the top of the panel 43 that receives a key (not shown) for unlocking and permitting the removal of panel 43*a*, may be and preferably is used to guard against undesirable displacement of the floor insert 43*a*. The panel insert 43 is also preferably provided with suction fittings 43*b* secured at to the underside of the panel 43 and at openings in the panel 43

From the foregoing, it is apparent that the improved integrated swimming pool and spa system of the present invention includes the capability of use of the spa alone such as when the swimming pool is inactive. This is a very desirable feature which is translatable to an economic advantage. in other words during the winter time, especially in temperate climates, during the periods of relatively coooler weather when use of the swimming pool is less inviting and the swimming pool is likely to be covered over, the spa with its heated water capability is readily available for use on a year round basis. This advantage of uninterrupted availability is possible by the plumbing arrangement disclosed hereinabovewith reference to FIGS. 11 and 11A of the drawing. The spa of the system of the invention is, accordingly, capable of being used continuously and independently of the swimming pool and, in particular, for example, when the swimming pool may have been winterized ,i.e., when the swimming pool is closed and secured against use or when the swimming pool may be in need of repair or refurbishing. During such use, i.e., when the swimming pool is not in use, the water circulating, heating and filtering system, which is devised to be alternatively avilable to service both swimming pool and spa via the above referred to water flow valving system, is adjusted to supply the spa only. It is apparent that when the swimming pool is not in use, the water circulation through the spa is adjusted to maintain the water level in the spa at a suitable level, the overflow or waterfall capability when water is permitted to spill over into the swimming pool being reserved for times when the swimming pool is also open.

While the invention as described and shown in the accompanying drawings presents a preferred embodiment, it will be understood that the invention as claimed may be modified in various details without departing from the spirit of the invention.

What is claimed is:

1. In an in-ground swimming pool of the type which is prefabricated as a package that is brought to a construction site, said swimming pool having a wall formed from a plurality of modular wall panels joined end-to-end to form the swimming pool enclosure, said wall panels having braces on the back side thereof that support the wall and support a peripheral deck contiguous with the top edge of the wall, said swimming pool being equipped with a water circulation pump, water heater and skimmer, the improvement in combination comprising:

a substitute wall panel for the swimming pool that replaces a swimming pool modular wall panel and is connected at its side edges with adjacent modular wall panels, said substitute panel functioning in a dual capacity as a part of the supporting wall of the swimming pool and as a part of an outer enclosing support wall for a preformed plastic therapy spa unit that is positioned within said spa enclosing support wall, an integrally formed plastic spa body that is inserted in said spa outer enclosing support wall, said spa body having an occupant seating area, a central footwell area and an enclosing wall, said spa and part of said spa enclosing support wall being disposed outside the periphery of the swimming pool supporting wall, said part of said spa enclosing support wall being provided with braces on the back side thereof.

2. The improved combination of claim 1 including a water impermeable vinyl liner that covers the wall and bottom of the swimming pool.

3. The improved combination of claim 1 including a continuous unitary poured concrete footing fixing the bottom of the braces supporting the swimming pool wall as well as the braces for the spa enclosing support wall in place.

4. The improved combination of claim 1 wherein said plastic spa body is provided with a recessed lip facing into the swimming pool through which water that overflows from the interior of said spa is discharged into the interior of the swimming pool.

5. The improved combination of claim 4 wherein the recessed lip is integrally formed with said spa body, said lip being effective to confine a stream of water that overflows from the interior of said spa into the interior of the swimming pool.

6. The improved combination of claim 4 wherein the recessed lip has upturned ends to confine water that overflows from the interior of said spa and is discharged into the interior of the swimming pool.

7. The improved combination of claim 4 wherein the integrally formed plastic spa body includes an integrally formed depending peripheral lip at the top thereof which depending lip fits over and covers the top edge of the outer enclosing spa support wall.

8. The improved combination of claim 1 wherein the modular wall panels of the swimming pool and the outer enclosing support wall for the spa are braced against outward displacement by an X-type brace which functions also to support at the top of the X-type brace a horizontal deck that surrounds the swimming pool and the contiguous spa, said deck comprising a unitary poured concrete strip.

9. The improved combination of claim 8 wherein a continuous broad beam of concrete is poured around and forms a footing fixing the bottom portions of the braces supporting the swimming pool wall and the spa outer enclosing support wall in place.

10. The improved combination of claim 8 wherein the X-type brace is provided with a reinforcing member joining the upper legs of said brace and the continuous concrete deck is poured around the outside of the top of the swimming pool and the spa outer enclosing support wall.

11. The improved combination of claim 1 wherein a common water filtration, heating and recirculation system provides service for both the swimming pool and spa.

12. The improved combination of claim 11 wherein water flow controls are provided to permit independent and alternative servicing of water flow to the swimming pool and to the spa.

13. The improved combination of claim 12 wherein the water flow controls are adjustable to maintain a non overflow mode in the spa.

14. The improved combination of claim 1 wherein said plastic spa body is provided with a removably secured wading pool floor panel that is adapted to be positioned over the spa footwell, covering the footwell and forming a floor that comprises the area of the panel and the seating area thereby converting the spa to a child wading pool.

15. The improved combination of claim 14 wherein the wading pool floor panel is provided with a locking means that requires a positive unlocking to extract the floor panel from its secured position over the footwell.

16. The improved combination of claim 14 wherein the wading pool floor panel is provided with suction fittings attached to the underside of said panel.

17. A method of constructing an in-ground swimming pool of the type which is prefabricated as a package that is brought to a construction site, said swimming pool having a wall formed from a plurality of modular wall panels joined end-to-end to form the swimming pool enclosure, said wall panels having braces on the back side thereof that support the wall and support a peripheral deck contiguous with the top edge of the wall, said swimming pool being equipped with a water circulation pump, water heater and skimmer, the method comprising the steps:

substituting a modular wall panel for the swimming pool with a replacement modular panel that is connected at its side edges with adjacent modular wall panels, said replacement panel functioning in a dual capacity as a part of the supporting well of the swimming pool and as a part of an outer enclosing support wall for a preformed plastic therapy spa unit that is positioned within said spa enclosing support wall, said spa enclosing support wall being disposed outside the periphery of the swimming pool supporting wall applying braces on the back side of said spa enclosing support wall, positioning an integrally formed plastic spa body in said spa enclosing support wall, said spa body having an occupant seating area, a central footwell area and an enclosing wall, and pouring a continuous broad beam of concrete around the outside of the swimming pool and said spa enclosing support wall to form a footing fixing the bottom portions of the braces supporting the swimming pool wall and the spa outer support wall in place.

18. The method of claim 17 wherein X-type braces are employed and the upper portions of said braces are joined by a connecting reinforcement member and a continuous concrete deck is poured around the outside of the swimming pool and the spa enclosing support wall and embedding the said upper portions of said braces and the connecting reinforcement member therein joining said upper portions.

* * * * *